US009050716B2

(12) United States Patent
Geissenhoener

(10) Patent No.: US 9,050,716 B2
(45) Date of Patent: Jun. 9, 2015

(54) EMERGENCY ACTUATING TOOL

(71) Applicant: Dr. Ing. h.c. F. Porsche Aktiengesellschaft, Stuttgart (DE)

(72) Inventor: Kai Geissenhoener, Suhl (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 272 days.

(21) Appl. No.: 13/707,820

(22) Filed: Dec. 7, 2012

(65) Prior Publication Data

US 2013/0145561 A1 Jun. 13, 2013

(30) Foreign Application Priority Data

Dec. 12, 2011 (DE) ..... 10 2011 056 274

(51) Int. Cl.
*B25F 1/02* (2006.01)
*B25G 1/00* (2006.01)
*B25B 13/48* (2006.01)

(52) U.S. Cl.
CPC . *B25F 1/02* (2013.01); *B25G 1/005* (2013.01); *B25B 13/48* (2013.01)

(58) Field of Classification Search
USPC ..... 7/100, 170; 81/437–439, DIG. 5
See application file for complete search history.

(56) References Cited

U.S. PATENT DOCUMENTS

| | | | | |
|---|---|---|---|---|
| 1,528,892 | A * | 3/1925 | Pigott et al. | 81/DIG. 5 |
| 6,279,434 | B1 * | 8/2001 | Brown | 81/437 |
| 6,502,483 | B1 * | 1/2003 | Swank et al. | 81/437 |
| 6,679,142 | B1 * | 1/2004 | Lin | 81/437 |

FOREIGN PATENT DOCUMENTS

| | | |
|---|---|---|
| DE | 90 17 796 U1 | 4/1992 |
| DE | 44 19 176 C1 | 6/1995 |
| DE | 202 10 760 U1 | 1/2004 |

* cited by examiner

*Primary Examiner* — Hadi Shakeri
(74) *Attorney, Agent, or Firm* — RatnerPrestia

(57) ABSTRACT

An emergency actuating tool for at least one equipment component which is specific to a vehicle with a movable roof arrangement, has at least one tool head for the equipment component, which tool head has an actuating element. For an alternative embodiment of the emergency actuating tool, it is provided that the emergency actuating tool has, moreover, at least one second tool head which has a second actuating element, that the emergency actuating tool is configured in multiple pieces, such that it can be assembled and at least partially dismantled, and that a third tool head with a third actuating element can be exposed by the dismantling of the emergency actuating tool.

20 Claims, 2 Drawing Sheets

EMERGENCY ACTUATING TOOL

CROSS-REFERENCE TO RELATED APPLICATIONS

This application claims priority to German Patent Application No. 10 2011 056 274.5, filed Dec. 12, 2011, which is incorporated by reference herein in its entirety.

FIELD OF THE INVENTION

The invention relates to an emergency actuating tool for at least one equipment component which is specific to a vehicle with a movable roof arrangement.

BACKGROUND OF THE INVENTION

An emergency actuating tool of this type is known from DE 44 19 176 C1, which is incorporated by reference herein. The emergency actuating tool has a tool head which is equipped with an actuating element which is configured here as a positively locking element. The equipment component, a drive of a sliding roof here, can be actuated by way of the tool head if the regular drive for the sliding roof fails. The emergency actuating tool is of crank-like configuration and, at one end, has the tool head with the actuating element which is formed by two lateral lobes which can engage into a gear pinion of a drive motor, with the result that the gear pinion can be rotated with the crank.

Emergency actuating tools for vehicles with a movable roof arrangement which have a specific equipment component in this regard are also known, for example, from DE 90 17 796 U1 and DE 202 10 760 U1, which are incorporated by reference herein.

SUMMARY OF THE INVENTION

It would be advantageous to specify an emergency actuating tool of the type mentioned at the outset in an at least alternative embodiment or in an embodiment that affords greater comfort for the vehicle user.

According to one aspect of the invention, an emergency actuating tool, which is specific to a vehicle with a movable roof arrangement, has at least one tool head for the equipment component, which tool head has an actuating element, wherein the emergency actuating tool has, moreover, at least one second tool head which has a second actuating element, in that the emergency actuating tool is configured in multiple pieces, such that it can be assembled and at least partially dismantled, and in that a third tool head with a third actuating element can be exposed by the dismantling of the emergency actuating tool.

The advantages which can be achieved by way of the emergency actuating tool according to aspects of the invention can be seen in the fact that a plurality of specific equipment components of the vehicle with a movable roof arrangement can be actuated in emergency operation by way of a single emergency actuating tool, and that the assembled emergency actuating tool can be stored comfortably in the vehicle in a simple way. Moreover, it is advantageous that the dimensions of the emergency actuating tool can be changed as a result of the ability to dismantle said emergency actuating tool, with the result that even poorly accessible equipment components can be reached with the emergency actuating tool. Different equipment components can be actuated in an emergency by virtue of the fact that the emergency actuating tool has a plurality of, preferably different, tool heads.

In the context of this application, the following are understood to be among the equipment components which are specific to a vehicle with a movable roof arrangement, the following list not being conclusive: parts or the complete roof of the movable roof arrangement, such as sliding roofs or cabriolet folding roofs, drive devices for roof arrangements of this type, what are known as frame flaps for closing and opening passage openings for frame parts of the movable roof arrangements, folding top tray lids, wind protector devices, such as a windstop or a wind deflector, hydraulic systems, locking and unlocking devices for a folding top tray lid or the roof itself, sunblind arrangements which serve as shade elements in transparent roof arrangements, access covers for the specific equipment components, etc.

According to one development, the multiple-piece emergency actuating tool is of two-piece construction. By way of the two-piece embodiment, a plurality of tool heads with corresponding actuating elements can be attached without problems.

According to one preferred development, it is provided that there is a coupling device between the parts of the emergency actuating tool, which coupling device makes the assembly and dismantling of the emergency actuating tool possible, a receptacle being formed on one of the parts for a plug-in part of the other part of the emergency actuating tool. For example, the coupling device can also have a latching or clip-in connection. The plug-in part can preferably be clipped into an at least partially open receptacle.

Furthermore, one development of the invention is preferred, in which one part of the emergency actuating tool is produced from a plastic. In a plastic part of this type, a plurality of tool heads can be produced in a simple way.

According to one preferred development of the invention, it is provided that another part of the emergency actuating tool is produced from a metallic material. A tool head which is also suitable for the transmission of relatively great actuating forces can be configured on a part which is produced from metal.

According to one development of the invention, it is provided that the assembled emergency actuating tool has an L-shape. This firstly improves the accessibility to the equipment component, and secondly a corresponding lever can be provided as a handle for the user as a result of the L-shape.

Furthermore, in one development of the invention, a tool head will preferably be arranged at each end of the L-shaped emergency actuating tool.

Furthermore, one exemplary embodiment is preferred, in which the emergency actuating tool has an additional or fourth tool head with an actuating element. Here, it can be provided in one development that the fourth tool head is formed on a corner region of the L-shaped emergency actuating tool.

One particularly preferred development of the invention is distinguished by a marking on the emergency actuating tool. This marking can mark, for example, an attachment point for the emergency actuating tool on an equipment component, in particular when the equipment component is arranged in a concealed manner, that is to say is not visible. In addition or as an alternative, the marking can mark an actuating stage of the equipment component, with the result that, for example, the marking indicates an unlocking or release of the equipment component upon a rotation or movement of the emergency actuating tool. The marking can indicate, in particular, a relative position of an actuating element of the emergency actuating tool with regard to the equipment component.

Furthermore, one exemplary embodiment is preferred, in which the two parts of the two-piece emergency actuating tool likewise per se have an L-shape. As a result, the two parts can be coupled to one another in a simple way.

In one development, at least one of the tool heads will have a positively locking element as actuating element. Positively locking elements of this type can have, for example as Torx, hexagon socket or hexagon head, slotted blades or crossed slot blades, generally internal or external polygonal arrangements.

Furthermore, one exemplary embodiment is preferred, in which the tool heads are connected fixedly to the emergency actuating tool or the respective part of the emergency actuating tool. An exchangeability of the tool heads on the emergency actuating tool itself is therefore not provided.

The features which are described and shown in this application can be combined alone per se and in any desired combination with another of the features which are described and shown. This also applies to a feature which is combined together with another feature which is described and/or shown.

BRIEF DESCRIPTION OF THE DRAWINGS

In the following text, the invention will be explained in greater detail using one exemplary embodiment with reference to the drawing, in which.

DETAILED DESCRIPTION OF THE DRAWINGS

Figure 1:
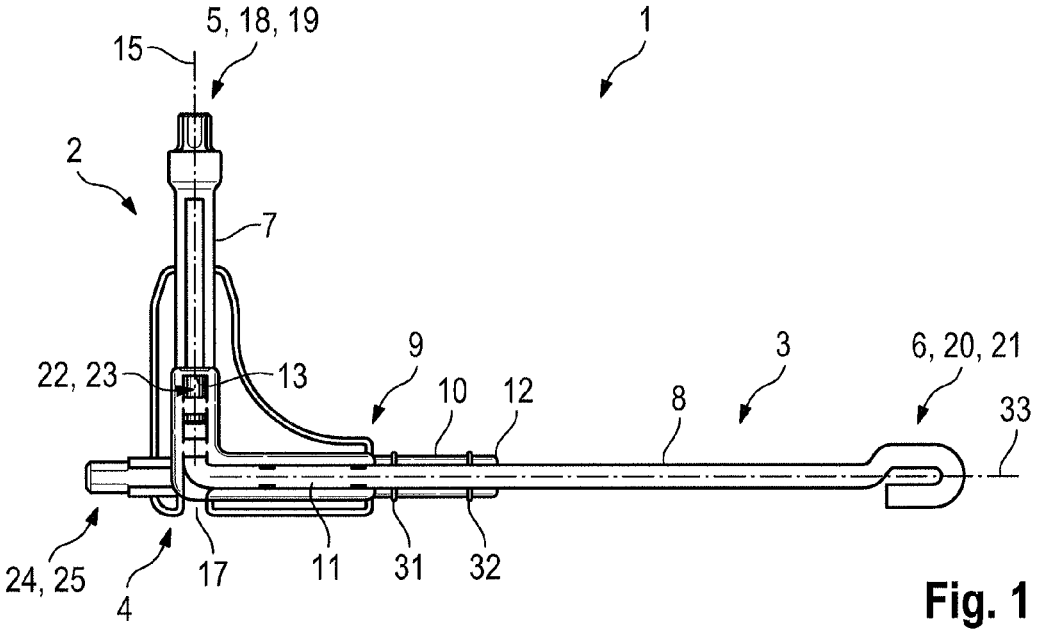
FIGS. 1 and 4 in each case show a plan view of the emergency actuating tool from above and from below, and FIGS. 2 and 3 in each case show side views of the emergency actuating tool.

FIG. 1 shows an emergency actuating tool 1 which is of L-shaped configuration according to the plan view which is shown in FIG. 1. It therefore has a first limb 2 and a second limb 3 and a corner region 4, in which the two limbs 2 and 3 meet one another. The emergency actuating tool 1 has a first outer end 5 on the first limb 2. A second outer end 6 of the emergency actuating tool 1 is provided on the second limb 3. The emergency actuating tool 1 is of multiple-piece, two-piece in the exemplary embodiment which is shown, configuration, a first part 7 being produced from a plastic and a second part 8 being produced from a metallic material. The two parts 7 and 8 are connected releasably to one another via a coupling device 9 which, on the first part 7, has a receptacle 10 for a plug-in part 11, the plug-in part 11 being formed on the second part 8. The two parts 7 and 8 extend in each case only over a part length of the L-shaped emergency actuating tool 1, with the result that the first part 7 also has an inner end 12 in addition to the outer end 5, and the second part 8 also has an inner end 13 in addition to the outer end 6. It can be seen that both parts 7 and 8 also in each case themselves have an L-shape, with the result that the respective first and second limb 2, 3 of the emergency actuating tool are formed by overlapping sections of the parts 7 and 8.

Figure 2:
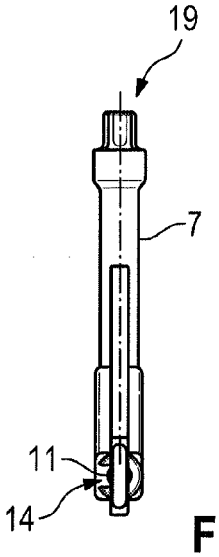
Figure 3:
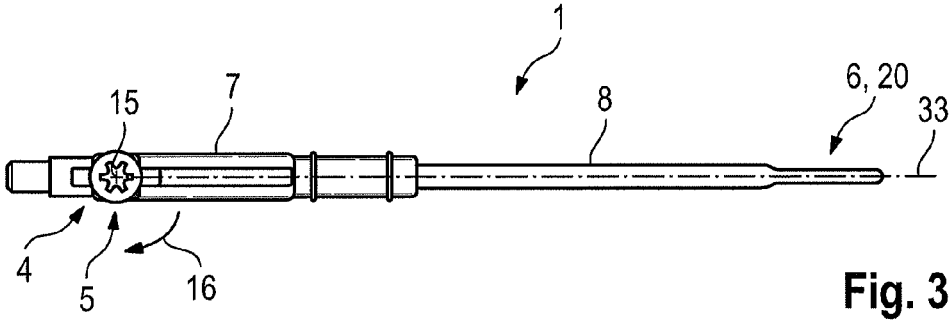

The receptacle 10 of the coupling device 9 is formed in the plastic part 7, in the region of the second limb 3 and also in a section of the first limb 2, as a channel 14 with open edges which receives the plug-in part 11 and encloses it partially on its circumference in such a way that the plug-in part 11 is received in a latched or clipped manner in the channel 14 with open edges (FIG. 2). In the region of the first limb 2, the channel 14 is at least partially circumferentially closed, that is to say is configured as an annular section. The plug-in part 11 of the second part 8 is held reliably as a result of the selection of the open-edge cross section of the channel 14 in the region of the second limb 3 and the configuration in parts or in sections as an annular channel in the region of the first limb 2, with the result that both parts 7 and 8 are coupled to one another fixedly. In order to dismantle the emergency actuating tool, the two parts 7 and 8 are rotated relative to one another about an axis 15 which runs parallel to the first limb 2, as a result of which the second part 8 can be rotated with its plug-in part 11 out of the channel 14 with open edges in the arrow direction 16 (FIG. 3). In order that the second part 8 can also be pulled out of the annular section of the channel 14, the channel 14 also has a side opening 17 in the corner region 4. After rotation has taken place in the arrow direction 16, the second part 8 can therefore be separated from the first part by being pulled out of the channel through the side opening 17. The emergency actuating tool 1 can be assembled in the reverse way. The emergency actuating tool 1 can therefore be dismantled and assembled.

At the outer end 5, the emergency actuating tool 1 has a first tool head 18 with an actuating element 19 for an equipment component (not shown here) of the vehicle (likewise not shown here) with a movable roof arrangement. The first actuating element 19 is configured as a positively locking element, in particular is realized as a Torx, and serves, in particular, to switch a hydraulic system (not shown here) of the vehicle to pressureless for an emergency actuation of the equipment component. At the other outer end 6 of the emergency actuating tool 1, a second tool head 20 with a second actuating element 21 is configured. The actuating element 21 is likewise realized as a positively locking element in the form of a hook or an eye. It serves, in particular, to actuate a locking device of a folding top tray lid (not shown here). A third tool head 22 with a third actuating element 23 is configured at the inner end 13 of the second part 8. it can likewise be realized as a positively locking element in the form of a Torx. The third actuating element 23 is provided, in particular, for the emergency actuation of a windstop (not shown here) which can be adjusted by motor between a rest position and an active position. A fourth tool head 24, which forms part of the plastic part 7, is located in corner region of the tool 1 and is aligned with the second limb 3. The fourth tool head 24 has a fourth actuating element 25 which is likewise configured as a positively locking element, in particular in the form of a hexagon socket. Said actuating element 25 serves, in particular, for the emergency actuation of what is known as a folding top lock (not shown here) which can releasably lock a front roof tip (not shown) of a folding top to an upper windshield cowl of the motor vehicle (not shown).

By dismantling of the emergency actuating tool 1 in the above-described way, the third tool head 22 with the third actuating element 23 is exposed. The second part 8 of the emergency actuating tool 1 can therefore be used separately without the first part 7. As a result of the dismantling of the emergency actuating tool 1, the third actuating element 23 on the third tool head 22 is therefore exposed when the second part 8 is removed from the coupling device 9. It goes without saying that the emergency actuating tool 1 can also be assembled again, with the result that the third tool head is arranged in a concealed manner in the channel 14.

Figure 4:
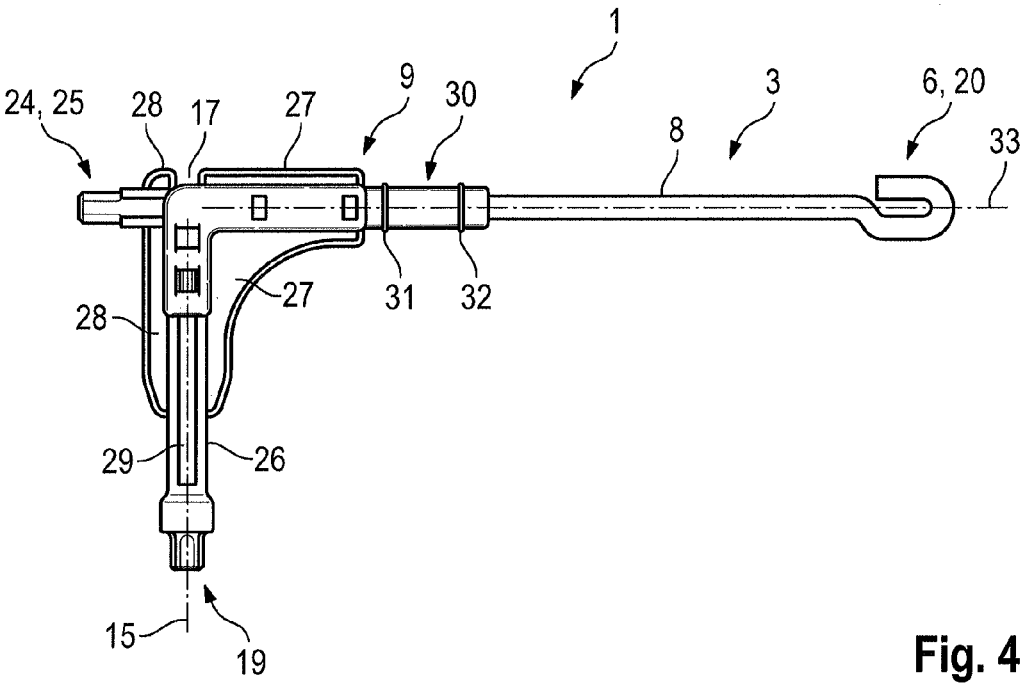

As FIGS. 1 and 4 show, the first part 7 not only has the channel 14 for the coupling device 9, but also continues with a tubular section 26 beyond the end 13 as far as the tool head 18. Between the channel 14 and the tubular section 26, the first part 7 has lobe-like reinforcements 27 and 28 which also continue in the region of the second limb 3. This increases the stability of the plastic part 7. In order to increase the rigidity of the plastic part 7, a reinforcing insert 29 can also be arranged in the tubular section 26, as is apparent from FIG. 4.

Adjacently to the inner end 12, the first part 7 has a marking 30 which comprises two part markings 31, 32 which are arranged at a spacing from one another in the direction of extent of the second limb 3. Said part markings or the marking 30 serve/serves to make it possible to actuate the locking devices (not shown here) of the folding top tray lid, in general functional units which are actuated via the second tool head 20 during emergency operation and are arranged such that they are unseen or concealed. It is provided to this end, in particular, to push the emergency actuating tool 1 with the end 6 under a cover, the folding top tray lid here (not shown), until the first part marking 32 can still just be seen from above. A subsequent rotation of the emergency actuating tool 1 about an axis 33 which runs parallel to the second limb 3 serves to indicate a first relative position of the actuating element 21 with regard to the abovementioned functional unit. Further pushing in as far as the second part marking 31 indicates a second relative position of the actuating element 21 with regard to the functional unit or shows an actuating stage for the functional unit, with the result that the latter can be actuated.

It is also to be mentioned that at least one of the tool heads, in particular those which are formed on the plastic part 7, that is to say the tool heads 18 and 24, can be connected to the first part 7 via a predetermined break point, as a result of which actuating forces which occur during the emergency actuation for the equipment component can be limited, as a result of which damage of the equipment component is avoided. If the actuating force exceeds a value (torque) which is set via the predetermined break point, the predetermined break point breaks.

What is claimed:

1. A two-part emergency actuating tool comprising a first part that is removably connected to a second part, the first part of the tool having a first tool head extending along a longitudinal axis, which first tool head has an actuating element, wherein the second part of the tool has at least one second tool head which has a second actuating element, wherein the emergency actuating tool is configured to be assembled and at least partially dismantled, and wherein a third tool head of the second part of the tool with a third actuating element is exposed by dismantling the emergency actuating tool, wherein the second part of the tool is configured to be removed from the first part of the tool by first rotating the second part about the longitudinal axis of the first tool head to align with a side opening of a corner region along the longitudinal axis while the first part of the tool remains stationary to uncouple a releasable connection between the second part and the first part, and thereafter translating the second part of the tool through the side opening along the longitudinal axis of the first tool head in a direction away from the first tool to completely detach the second part from the first part.

2. The emergency actuating tool as claimed in in claim 1 further comprising a coupling device for coupling the second part to the first part of the emergency actuating tool, a receptacle being formed on the coupling device for accommodating the second part of the emergency actuating tool.

3. The emergency actuating tool as claimed in claim 2, wherein the coupling device comprises a clip connector on the first part of the tool that is configured to releasably receive the second part of the toot.

4. The emergency actuating tool as claimed in claim 3, wherein the receptacle has an L-shape that extends along the longitudinal axes of both the first part and the second part of the tool.

5. The emergency actuating tool as claimed in claim 4, wherein a diameter of the receptacle is substantially constant along its length dimension.

6. The emergency actuating tool as claimed in claim 4, wherein the L-shaped receptacle is intersected by the side opening formed in the first, part through which the third tool head is removed upon separating the first part of the tool from the second part of the tool.

7. The emergency actuating toot as claimed in claim 4, wherein walls of the L- shaped receptacle define the clip connector.

8. The emergency actuating tool as claimed in claim 3, wherein the first part of the tool including the clip connector is composed of plastic.

9. The emergency actuating tool as claimed in 1, wherein one part of the two-part emergency actuating tool is produced from a plastic.

10. The emergency actuating tool as claimed in claim 9, wherein the other part of the two-part emergency actuating tool is produced from a metallic material.

11. The emergency actuating tool as claimed in claim 1, wherein the assembled emergency actuating tool has an L-shape.

12. The emergency actuating tool as claimed in claim 11, wherein the first tool head is arranged at one free end of the L-shaped emergency actuating tool, and the second tool head is arranged at another free end of the L-shaped emergency actuating tool.

13. The emergency actuating tool as claimed in claim 12, further comprising a fourth tool head with a fourth actuating element.

14. The emergency actuating tool as claimed in claim 13, wherein the fourth tool head is formed on the corner region of the L-shaped emergency actuating tool.

15. The emergency actuating tool as claimed in claim 13, wherein the fourth tool head is substantially aligned with the second tool head.

16. The emergency actuating tool as claimed in claim 1, further comprising a marking which marks at least one relative position of the emergency actuating tool with regard to an equipment component and/or a functional unit for the equipment component.

17. The emergency actuating tool as claimed in claim 1, wherein the two parts of the emergency actuating tool each have an L-shape.

18. The emergency actuating tool as claimed in claim 1, wherein at least one of the tool heads has a positively locking element as an actuating element.

19. The emergency actuating tool as claimed in claim 1, wherein an entirety of the first part of the tool is composed of a different material than an entirety of the second part of the tool.

20. The emergency actuating toot as claimed in claim 1, wherein the second part of the tool is clipped to the first part of the tool.

* * * * *

UNITED STATES PATENT AND TRADEMARK OFFICE

CERTIFICATE OF CORRECTION

PATENT NO. : 9,050,716 B2
APPLICATION NO. : 13/707820
DATED : June 9, 2015
INVENTOR(S) : Kai Geissenhöner It is certified that error appears in the above-identified patent and that said Letters Patent is hereby corrected as shown below:

In the Claims

In Column 6, Line 13, Claim 7, delete “toot” and insert --tool--, therefor.

In Column 6, Line 57, Claim 20, delete “toot” and insert --tool--, therefor.

Signed and Sealed this
Twentieth Day of October, 2015

Michelle K. Lee

Michelle K. Lee
*Director of the United States Patent and Trademark Office*